US005111641A

United States Patent [19]

Brown et al.

[11] Patent Number: 5,111,641

[45] Date of Patent: May 12, 1992

[54] INNER POUCH SEALING APPARATUS AND METHOD

[75] Inventors: David L. Brown, Wallingford; Stanley J. Malinowski, Gilford, both of Conn.

[73] Assignee: United States Surgical Corporation, Norwalk, Conn.

[21] Appl. No.: 685,521

[22] Filed: Apr. 15, 1991

[51] Int. Cl.[5] ..... B65B 57/08; B65B 51/14; B65B 41/18

[52] U.S. Cl. ..... 53/477; 53/479; 53/51; 53/75; 53/76; 53/373.8; 53/374.8; 53/449; 156/293; 156/351

[58] Field of Search ..... 53/449, 479, 373.7, 53/373.8, 374.8, 375.6, 53, 75, 76, 477, 171, 51; 156/293, 351

[56] References Cited

U.S. PATENT DOCUMENTS

| | | | |
|---|---|---|---|
| 2,955,643 | 10/1960 | Shapero et al. | 53/76 |
| 3,449,887 | 6/1969 | Abramson | 53/76 |
| 3,706,177 | 12/1972 | Willett | 53/76 |
| 3,886,713 | 6/1975 | Mitchell et al. | 53/479 X |
| 4,082,596 | 4/1978 | Vanderpool | 53/76 X |
| 4,135,622 | 1/1979 | Glink . | |
| 4,353,770 | 10/1982 | Kuckhermann | 53/479 X |
| 4,482,053 | 11/1984 | Alpern et al. . | |
| 4,603,538 | 8/1986 | Shave | 53/425 |
| 5,007,233 | 4/1991 | Bose | 53/449 |

*Primary Examiner*—Horace M. Culver

*Attorney, Agent, or Firm*—Thomas R. Bremer; Peter G. Dilworth; Rocco S. Barrese

[57] ABSTRACT

A novel method and apparatus for sealing an inner pouch containing surgical instruments and/or elements in an outer breather pouch is provided. The method involves sequentially transporting a series of open inner pouches contained in an outer breather pouch to a viewing station wherein positioning data is obtained concerning the precise location of the inner pouch relative to a base position. Thereafter positioning data is transmitted to a sealing apparatus which adjustably positions a sealing means to consistently seal the inner pouch through the outer pouch material. The apparatus includes viewing mechanisms for determining the position of an inner pouch disposed in an outer pouch relative to a base position. Adjustable sealing apparatus communicates with the viewing mechanism to receive positioning information relating to the inner pouch. Based on this information the viewing apparatus is adjusted so as to be able to effect accurate sealing of the inner pouch disposed within the outer pouch.

14 Claims, 5 Drawing Sheets

INNER POUCH SEALING APPARATUS AND METHOD

BACKGROUND OF THE INVENTION

1. Field of the Invention

The present invention relates to sealing apparatus and methods, and more particularly to sealing apparatus and methods for sealing moisture permeation resistant pouches contained within an outer pouch.

2. Discussion of the Related Art

Packages for surgical instruments and elements, such as, for example, surgical suture-needles or sutures in general, constructed of moisture imperious materials are well known in the art. The material of which these packages are constructed usually include metallic foil outer layer, such as, for example tin or aluminum, which may be in laminate form with an inner layer of a thermoplastic heat sealable material which forms the interior surface of the package. Either before or after loading of the surgical instruments or elements, the inner pouches are heat sealed on three sides. The heat seal formed about the peripheral edge of the package may be supplemented by the addition of an adhesive material, such as, for example, polyethylene-based adhesive to facilitate bonding between the layers. The pouches are then sterilized in this open condition, typically by ethylene-oxide gas sterilization. After sterilization the pouches are transferred to a sterile room where the fourth side of the pouch is sealed and packaged into an outer pouch. The final step involves the resterilization of the inner and outer pouches, again by ethylene-oxide gas sterilization.

This method of packaging has several drawbacks which complicate the sealing and/or packaging of sterile surgical instruments and elements and may compromise the sterility of the packaged products For example, where sterilization precedes packaging of the surgical instruments, packaging equipment as well as the ambient environment must be maintained in a climate controlled sterile condition. This necessitates the provision of elaborate sterile facilities for handling, packaging and sealing of the surgical instruments and elements as well as resterilization of the packaging. Further, maintenance of the equipment and movement of the products in and/or out of this sterile environment is inhibited lest the sterility be compromised.

To simplify this sterilization process, outer breather packages were developed for sterilizing and maintaining packaged surgical instruments and/or elements. These breather packages usually comprise a sheet of clear or opaque plastic adhered to a paper, cardboard, spun-bonded polyolefin or other fibrous material backing to provide a sterile display environment for the enclosed surgical instruments and/or elements. The breather pouches are typically provided with a port or panel which is pervious to sterilizing gas such as ethylene oxide while being impervious to bacteria and other contaminants. In particularly useful embodiments a fibrous material constructed of spun-bonded polyolefin known as Tyvek (a registered trademark of DuPont), is used as the backing material with an outer layer of clear or opaque mylar/polyethylene laminate being heat or adhesive sealed to the periphery of the Tyvek to form the breather pouch.

The inner moisture permeation resistant pouch is similar to that described above and typically comprises a 3 ply laminate construction with a mylar/polyester outer ply, an aluminum foil ply and a polyethylene ply with an adhesive coating thereon.

Using the outer breather pouch, sterilization of the inner pouch and its contents is greatly simplified. For example, the product to be packaged is placed in the inner pouch, which remains at least partially open, and the inner pouch is then sealed inside the breather pouch. Thereafter, the breather pouch with its open inner pouch is subjected to a sterilization process wherein the contents of the inner pouch are gas sterilized inside the breather pouch. After sterilization the inner pouch is sealed through the breather pouch resulting in a finished packaged sterilized product.

This packaging method avoids the need for elaborate and extensive sterile facilities and permits easy handling and movement of the products without compromising sterility. However, one drawback to this packaging method is that a high degree of precision is required in the sealing of the partially open inner pouch through the breather pouch. The inner pouch is confined within the breather pouch but is not necessarily found in the same position in all instances. Thus there is some degree of non-uniformity with respect to where the inner pouch is disposed in the breather pouch at any given time. To insure adequate closure without damage to the contents of the inner pouch special care must be taken to achieve correct alignment of the inner pouch prior to the sealing step. Manually orienting the breather pouches prior to sealing such that the inner pouch contained therein is correctly positioned prior to directing the pouches into a sealer apparatus is an unacceptable solution since this procedure is labor intensive and time consuming, and susceptible to error necessitating constant vigilance by the operator or supervisor.

It would be highly desirable to have apparatus which would automatically process the breather pouches containing open inner pouches prior to sealing the inner pouch such that the inner pouch is properly oriented for accurate sealing.

Accordingly, it is one object of the present invention to provide apparatus which permits consistent accurate sealing of the inner pouches without affecting the outer pouches.

It is a further object of the present invention to provide apparatus wherein the position of the inner pouches within the breather pouches is determined prior to directing the sealer apparatus to seal the inner pouches.

Another object of the present invention is to provide a method for sealing an inner pouch within a breather pouch such that consistent accurate seals of the inner pouch are obtained.

These and other highly desirable and unusual results are accomplished by the present invention in an apparatus and method for sealing an inner pouch containing surgical instrumentation and/or elements through an outer pouch.

Objects and advantages of the invention are set forth in part herein and in part will be obvious therefrom, or may be learned by practice with the invention, which is realized and attained by means of instrumentalities, methods and combinations pointed out in the appended claims. The invention comprises the novel parts, constructions, arrangements, combinations, methods, steps and improvements herein shown and described.

SUMMARY OF THE INVENTION

The present invention provides a novel method and apparatus for sealing an inner pouch containing surgical instruments and/or elements within an outer breather pouch. The method involves sequentially transporting a series of at least partially open inner pouches, each contained within an outer breather pouch (hereinafter collectively referred to as "loaded pouches"), to a viewing station wherein positioning data is obtained concerning the precise location of the inner pouch relative to a preset base position. In particularly advantageous embodiments of the present method the positioning data is optically determined relative to a base position. Position data is then transmitted to a sealing apparatus which is adjustable relative to the base position. The sealing apparatus orientation is adjusted so as to be in position to accurately seal the inner pouch through the outer pouch material.

Apparatus for carrying out this method include viewing apparatus which determines the position of an inner pouch disposed in an outer pouch relative to a preset base position. Adjustable sealing apparatus communicates with the viewing apparatus to receive positioning information relating to the inner pouch. Based on this information, the sealing apparatus orientation is adjusted so as to be able to effect accurate sealing of the inner pouch disposed within an outer pouch. In particularly useful embodiments a sequential transport mechanism is used to sequentially present a large volume of individual loaded pouches to a viewing station and then on to a sealing apparatus. This enables a large volume of loaded pouches to be accurately and efficiently sealed.

The viewing apparatus may preferably comprise an optical photoelectric line array sensor in combination with a control module to produce an analog voltage signal corresponding to the position of an inner pouch relative to a preset base position. This signal is transmitted to the adjustable sealing apparatus, for example, a thermal bar sealer adjustably mounted by means of a stepper motor-ball screw arrangement. In a simple configuration, the sealing apparatus is adjustable in the vertical (i.e., Y-axis) direction however, where desirable, the sealing apparatus could be made adjustable in the X-, Y-, and/or Z-direction by adding, for example, additional stepper motor-ball screw assemblies or their equivalent.

The thermal bar sealer is automatically positioned by the stepper motor-ball screw assembly so as to present the sealing bar in position to precisely seal the inner pouch through the outer pouch. After sealing, the final product, i.e. the sealed inner pouch disposed within the sealed outer pouch, is discharged from the unit for further handling as necessary.

BRIEF DESCRIPTION OF THE DRAWINGS

The accompanying drawings, referred to herein and constituting a part hereof, illustrate preferred embodiments of the inner pouch sealer apparatus in accordance with the present invention and, together with the description, serve to explain the principles of the invention.

DETAILED DESCRIPTION OF PREFERRED EMBODIMENTS

Figure 1:
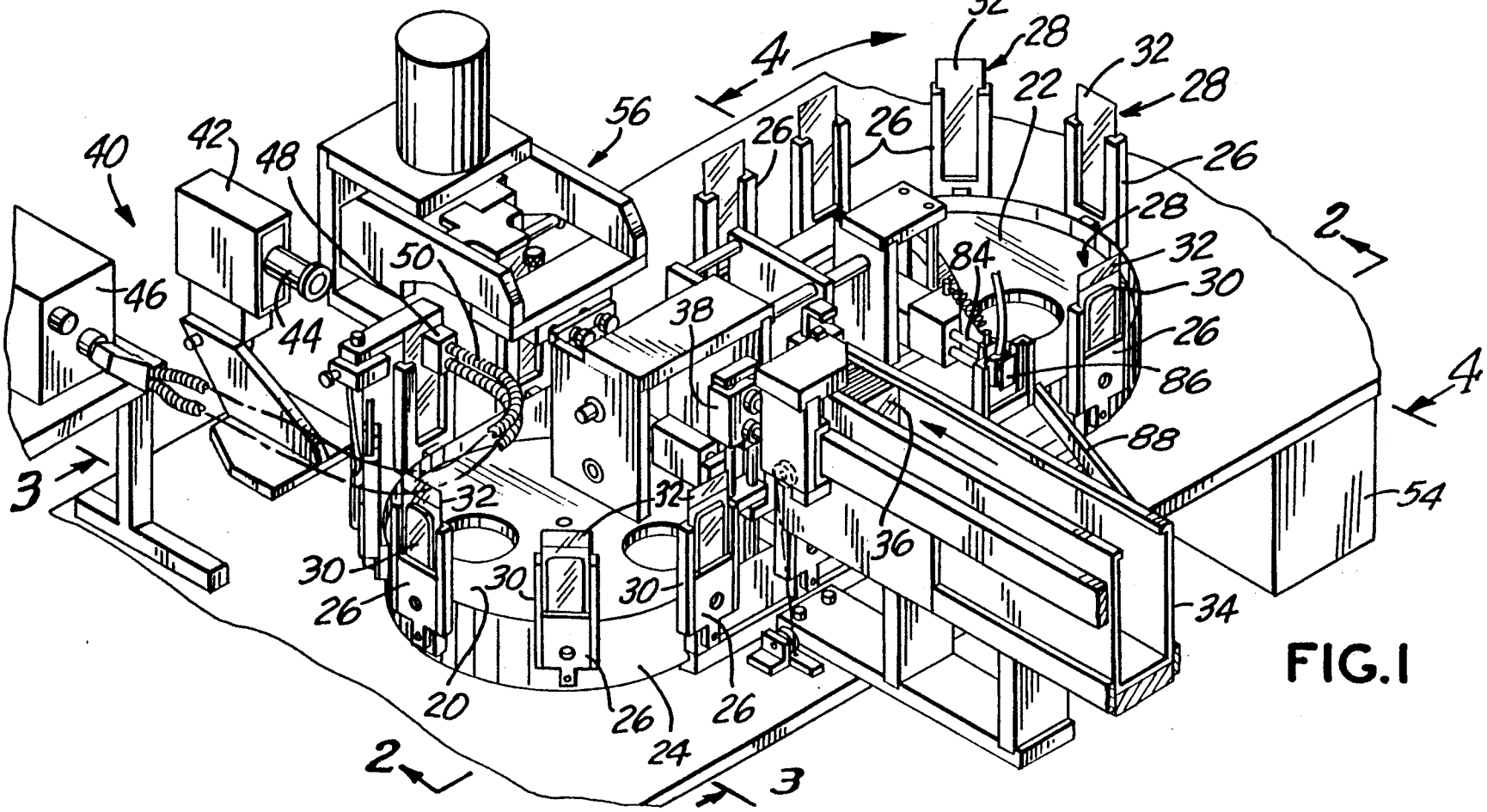
FIG. 1 is a perspective view of an automated inner pouch sealer apparatus of the present invention.
Figure 5:
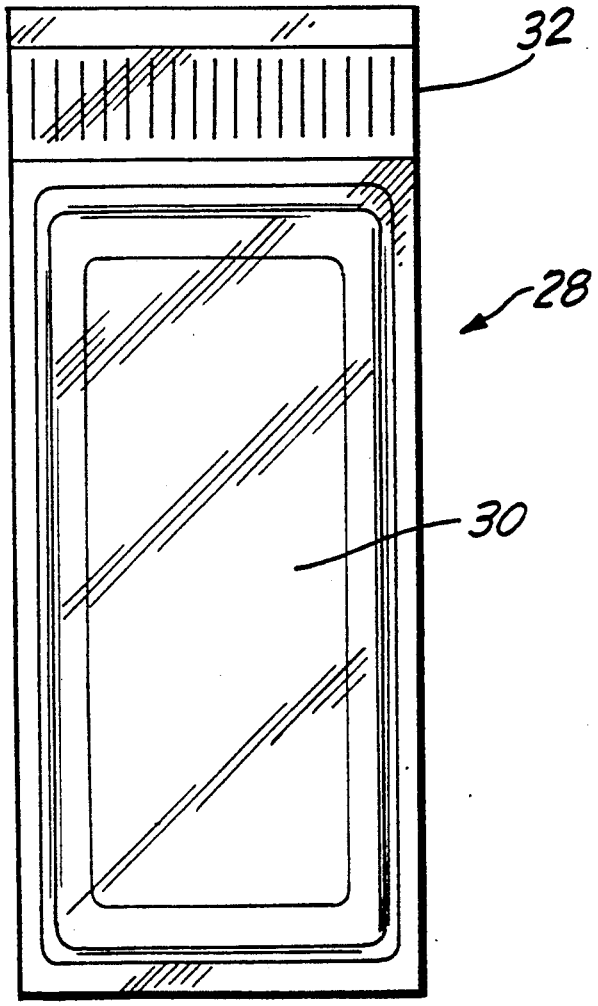
FIG. 5 is a front plan view of a loaded pouch.

Referring to the figures and in particular to FIG. 1 there is shown an inner pouch sealer apparatus in accordance with the present invention. This embodiment utilizes a transport mechanism having a pair of horizontally disposed wheels 20, 22 driving an endless web 24 around the periphery thereof. A plurality of nests 26 are attached to the outside of the endless web 24 and are driven in a sequential clockwise manner by wheels 20 and 22. Nests 26 comprise substantially U-shaped frame structure having a vertically disposed pocket formed in a lower portion thereof and being open at the top. In the embodiment of FIG. 1, nests 26 are configured and dimensioned to retain an individual loaded pouch 28 (FIG. 5) comprising a partially open inner pouch 30 contained within an outer breather pouch 32. In the present embodiment outer breather pouch 32 comprises a layer of clear or opaque plastic sealed to a backing material which is opaque relative to the inner pouch 30. The inner pouch comprises a moisture permeation resistant container constructed of a laminate having a metallic foil outer layer and an inner layer of a thermoplastic heat sealable material.

The loaded pouch 28 is maintained vertically in nest 26 with at least an upper portion of the open inner pouch 30 discernable through the vertical parallel portion of the U-shaped frame structure.

Figure 2:
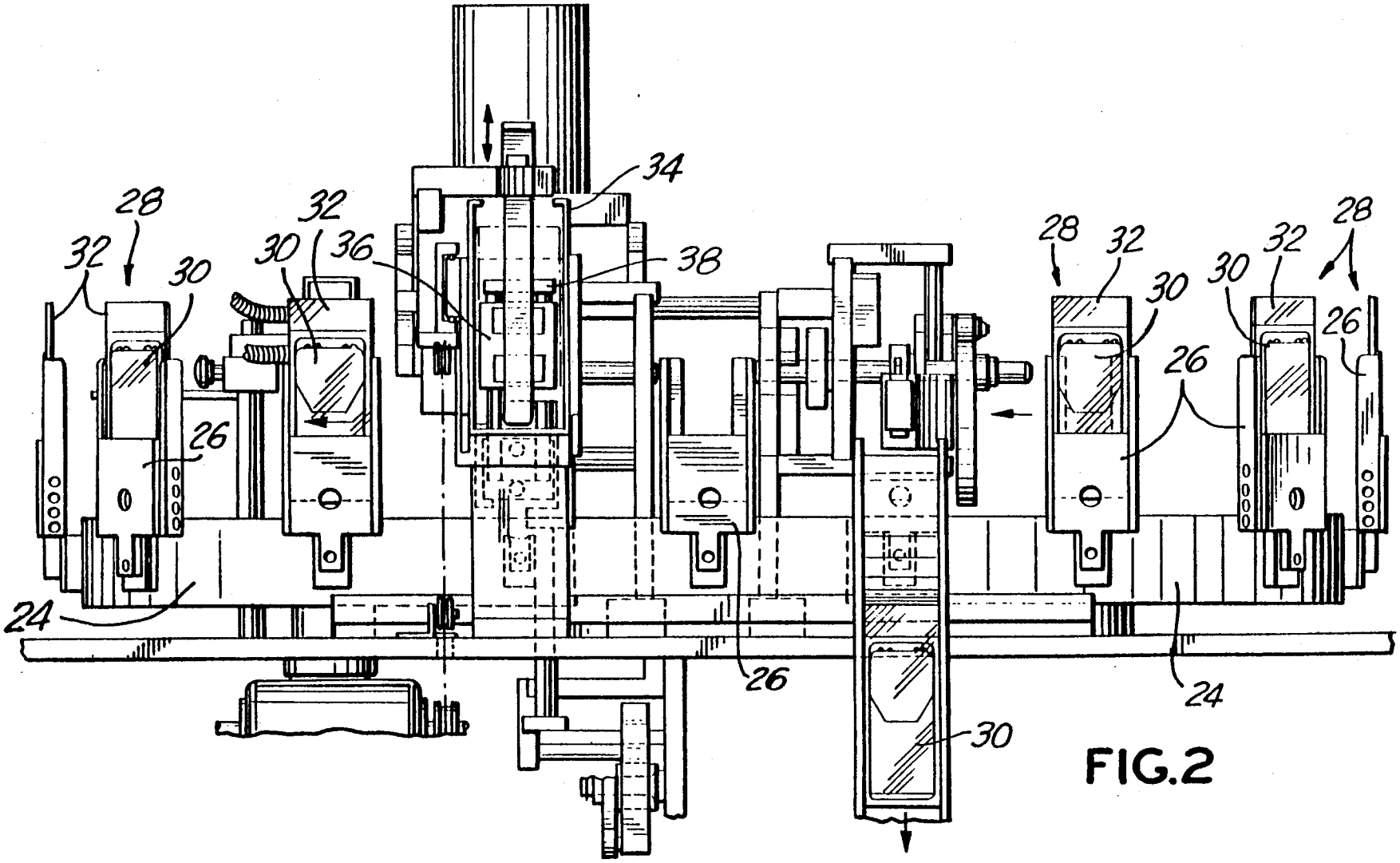
FIG. 2 is a side view facing the apparatus taken along line 2—2 of FIG. 1.

Referring to FIGS. 1 and 2, a supply of loaded pouches 28 to be sealed are serially disposed in magazine 34 perpendicular to the path of endless web 24. Magazine 34 comprises a substantially U-shaped channel dimensioned and configured to retain a supply of loaded pouches vertically in line. A spring loaded follower 36 maintains compression on the supply of loaded pouches to maintain them in a vertical orientation and to present them, one at a time, to a discharge opening located at a distal end of magazine 34. A vacuum driven stripping arm 38 is positioned in opposed facing relation to the discharge opening of magazine 34 and is activatable to strip a loaded pouch from the discharge opening of magazine 34 through the frame structure of nest 26 and deposit it into the pocket thereof as the nest moves into alignment therewith such that the clear or opaque side of the outer pouch 32 faces outward.

Figure 3:
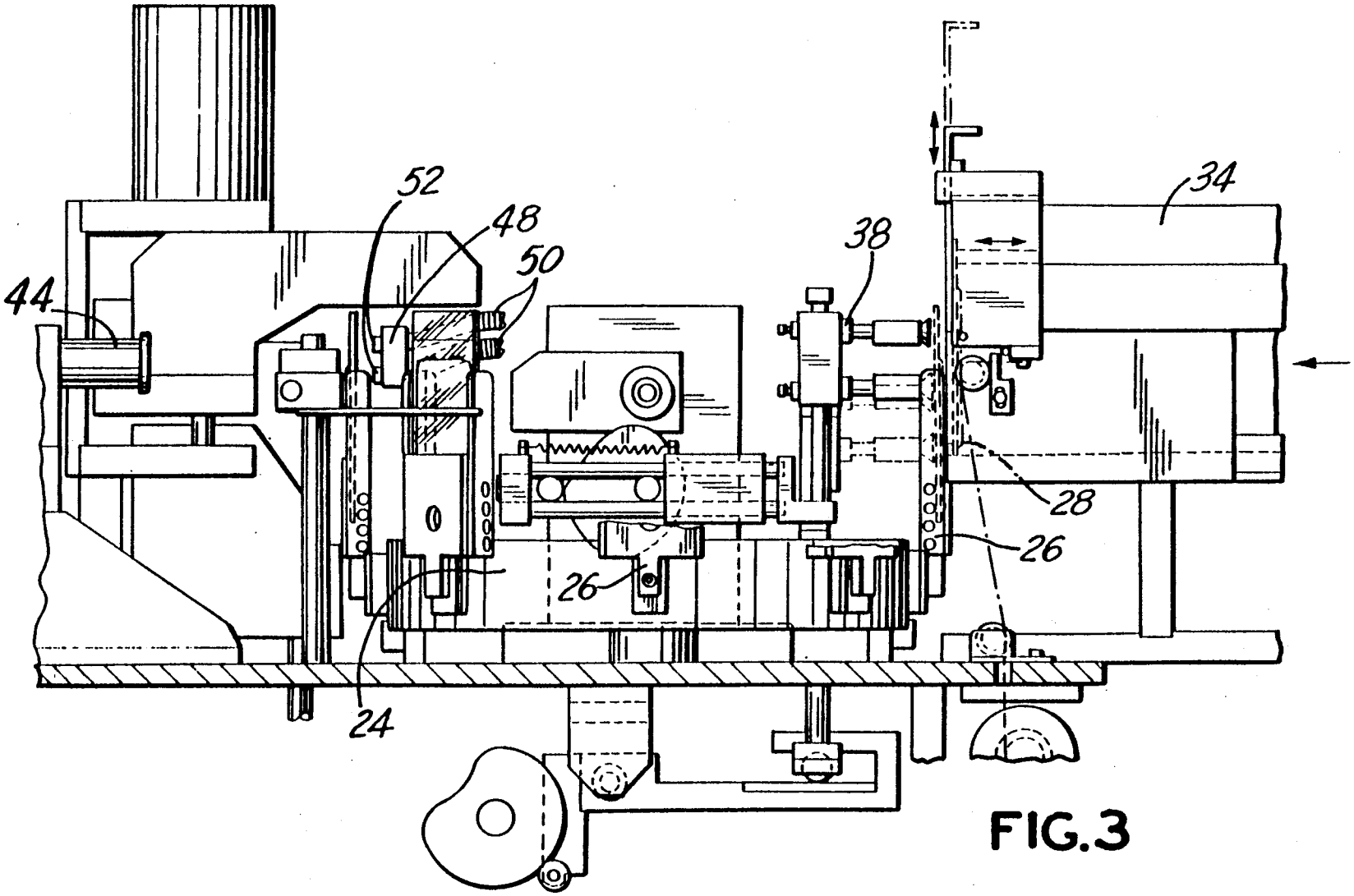
FIG. 3 is an end view of the apparatus taken along line 3—3 of FIG. 1.

Referring now to FIGS. 1 and 3, after a loaded pouch is inserted into a nest, the endless web 24 moves the nest to a viewing station, shown generally at 40. In this embodiment, the viewing station comprises a photoelectric line array sensor 42, lens 44, a light generator 46 and a light focusing block 48. The nest containing the loaded pouch stops in viewing station 40 such that the loaded pouch is disposed between the light focusing block 48 and the lens 44.

Light, in this case white light, is propagated through a pair of fiber optic conduits 50 to the light focusing block 48. A pair of focusing elements 52, positioned in over-under relationship in the light focusing block 48, direct two beams of light in parallel linear planes through the loaded pouch to the lens 44 of the photoelectric line array sensor 42. In this embodiment the light focusing block 48 is positioned in vertical alignment with an upper portion of the loaded pouch such that light from the focusing elements 52 encompasses an opaque or transparent portion of the outer pouch as well as a substantially less opaque or transparent portion of the inner pouch. As discussed in greater detail below, this arrangement enables the photoelectric line array sensor 42 to make an accurate determination of the top edge of the inner pouch within the outer pouch. In other embodiments contemplated by the present invention, a plurality of light focusing blocks and photoelectric line array sensors may be utilized in combination to determine the precise spacial orientation of the inner pouch.

A particularly advantageous photoelectric line array sensor in accordance with the present invention is the Model E63LB Photoelectric Line Array sensor manufactured by Cutler-Hammer (a division of EATON Corporation). This sensor includes a photoelectric receiver containing an array of 1×512 (Model E63-LBA2C) or 1×2048 (Model E63LBC2C) line sensitive elements (pixels). A lens focuses a slice of the viewed target, i.e. a back lit upper portion of a loaded pouch, onto the array. The array divides this image into 512 or 2048 pixels, depending on the model. Each pixel is recognized as being light or dark by means of an integral selectable threshold control. The resulting video signals are transferred to a control module whose continuous analog output voltage changes based on the number of light or dark pixels. In this manner the precise location of the upper edge of the inner pouch is identified. By establishing a base position or calibration point, the vertical height of the upper edge of the inner pouch from the base position is readily obtained.

This information is fed to a central processing unit 54 for example an IBM System 2 model 50 which utilizes this information to control the positioning of the sealer apparatus as detailed below.

Figure 4:
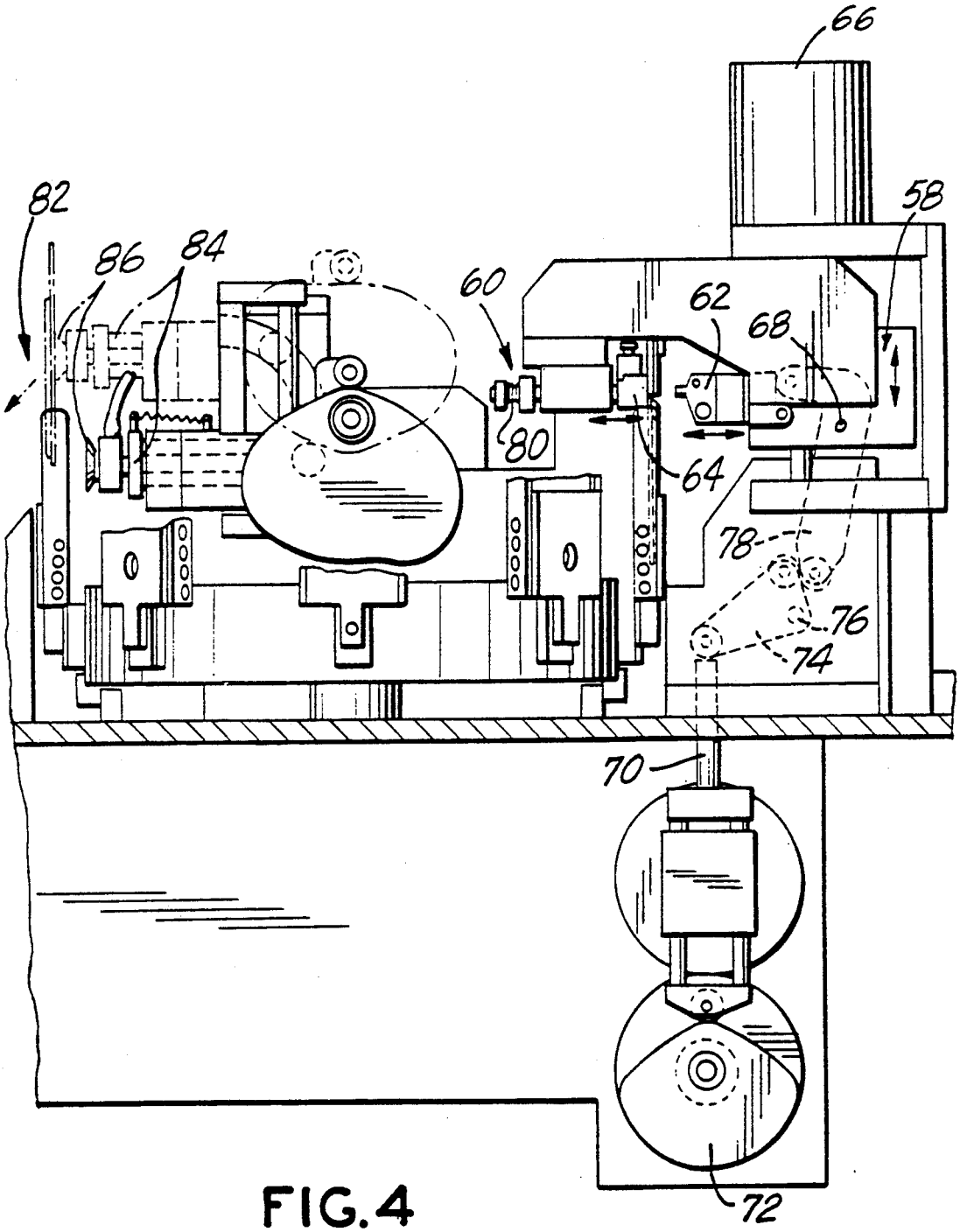
FIG. 4 is an end view of the apparatus taken along line 4—4 of FIG. 1.

After positioning data has been collected at the viewing station 40, endless web 24 is sequentially activated to move the nest 26 containing the examined loaded pouch to a sealing station 56. Referring to FIGS. 1 and 4, the sealing station comprising adjustably mounted sealing apparatus 58 with backing means 60. In the embodiment shown in FIGS. 1 and 4, a thermal bar sealer 62 is utilized in conjunction with a plexiglas backing block 64. The thermal bar sealer 62 is vertically adjustable by stepper motor 66 in response to controlling signals from the control processing unit 54. Although a thermal bar sealer 62 is shown and described herein, one of ordinary skill in the art would readily appreciate that other sealing apparatus would be appropriate including, but not limited to, pressure, impulse, dielectric or ultrasonic sealing apparatus.

The thermal bar sealer 62 utilized in this embodiment is a cam actuated bar sealer operated at a machine pressure of about 60 psi. The thermal bar sealer 62 is pivotally mounted about pin 68 and is horizontally movable by means of vertical reciprocal motion of shaft 70 caused by the rotation of cam 72. As shaft 70 moves upward it engages triangular link 74 and causes it to pivot clockwise about pin 76. Link 74 engages arm 78 thus moving the thermal bar sealer 62 in the distal direction to effect a sealing operation against backing block 64. Bumper springs 80 engage backing block 64 and assist in providing pressure along the sealing line when the thermal bar sealer 62 is engaged.

Prior to the sealing operation, the thermal bar sealer is heated to a temperature sufficient to cause the inner pouch to be sealed yet insufficient to cause damage to or sealing of the material of the sealed outer pouch. For the specific application of sealing foil inner pouches within Tyvek breath pouches, a temperature of about 245° F. to is preferred.

Referring to FIG. 4, stepper motor 66 receives positioning signals from the central processing unit 54 based upon positioning information obtained at the viewing station 40. These signals precisely control the vertical height of the thermal bar sealer 62 relative to the base position so as to position the sealer apparatus at the proper location on each individual inner pouch without damaging the contents thereof. Once in position, cam 72 effects the horizontal distal movement of the thermal bar sealer 62 to engage and seal the inner pouch through the outer pouch against the backing block 64.

After sealing of the inner pouch has been effected, endless web 24 is sequentially engaged to transport the sealed loaded pouches 28 in nests 26 to a discharge station 82. This discharge station comprises a pneumatic arm 84 with vacuum disk 86 and a discharge chute 88. When a sealed loaded pouch reaches the discharge station 82, pneumatic arm 84 moves distally allowing vacuum disk 86 to engage the sealed loaded pouch. Pneumatic arm 84 lifts the sealed loaded pouch out of nest 26 and discharges it to chute 88 for subsequent collection.

To the extent not already indicated, it also will be understood by those of ordinary skill in the art that any one of the various specific embodiments herein described and illustrated may be further modified to incorporate features shown in other of the specific embodiments.

The invention in its broader aspects therefor is not limited to the specific embodiments herein shown and described but departures may be made therefrom within the scope of the accompanying claims without departing from the principles of the invention and without sacrificing its chief advantages.

We claim:

1. A method for sealing an open inner pouch through an outer pouch comprising the steps of:

providing a supply of open inner pouches contained within outer pouches;

sequentially transporting individual inner pouches contained within an outer pouch to a viewing apparatus;

viewing said individual inner pouches to determine the position of said inner pouches relative to a base position;

generating a positioning signal from said viewing apparatus to a sealing apparatus;

positioning said sealing apparatus in response to said positioning signal; and sealing said individual inner pouches through said outer pouches.

2. A method as in claim 1 wherein the step of viewing said individual inner pouches to determine the position of said inner pouches is done optically.

3. A method as in claim 1 wherein the step of sealing said individual inner pouches through said outer blister pouches is done by a thermal bar sealer.

4. A method as in claim 1 wherein the step of positioning said sealing apparatus in response to said positioning signal includes aligning said sealing apparatus in an x and y direction.

5. A method as in claim 2 further comprising the steps of illuminating said individual inner pouches when they are in position proximate an optical viewing apparatus.

6. Apparatus for sealing an open inner pouch through an outer pouch comprising:

means for supporting at least one open inner pouch contained within an outer pouch;

viewing apparatus for determining the position of said open inner pouch contained within said outer pouch relative to a base position;

sealing apparatus communicating with said viewing apparatus to receive positioning information therefrom, said sealing apparatus being adjustable to seal said inner pouch contained within said outer pouch at a predetermined position on said inner pouch.

7. Apparatus as in claim 6 further comprising a supply of said inner pouches contained within said outer pouches and transport means for moving said pouches sequentially from said supply to said viewing apparatus and sealing apparatus.

8. Apparatus as in claim 6 wherein said viewing apparatus is an optical viewing system.

9. Apparatus as in claim 6 wherein said sealing apparatus is a bar sealer.

10. Apparatus as in claim 8 wherein said optical viewing system comprises a photoelectric line array sensor in combination with a control module and a light source.

11. Apparatus as in claim 10 wherein said photoelectric line array sensor includes a photoelectric sensor containing an array of 1 by 512 pixels.

12. Apparatus as in claim 10 wherein said photoelectric line array sensor includes a photoelectric sensor containing an array of $1 \times 2048$ pixels.

13. Apparatus as in claim 10 wherein said control module is adapted to receive video signals from said photoelectric line array sensor for a viewed inner pouch and to transmit positioning data to said sealing apparatus.

14. Apparatus as in claim 13 wherein said positioning data is received by said sealing apparatus and translated into vertical positioning movement of said sealing apparatus to seal said inner pouch contained within said outer pouch at a predetermined position on said inner pouch.

* * * * *